US005752648A

United States Patent [19]

Quaintance

[11] Patent Number: 5,752,648

[45] Date of Patent: May 19, 1998

[54] WEB BOTTOMED EIGHT SIDED TRAY

[75] Inventor: Benjamin W. Quaintance, Germantown, Tenn.

[73] Assignee: International Paper, Purchase, N.Y.

[21] Appl. No.: 666,037

[22] Filed: Jun. 19, 1996

[51] Int. Cl.[6] ..... B65D 21/02

[52] U.S. Cl. ..... 229/109; 229/918; 229/930; 229/939

[58] Field of Search ..... 229/109, 110, 229/918, 920, 930, 931, 939

[56] References Cited

U.S. PATENT DOCUMENTS

| | | | |
|---|---|---|---|
| 1,611,734 | 12/1926 | Gamm et al. | 229/930 |
| 2,021,980 | 11/1935 | Bachmeyer | 229/930 |
| 2,749,018 | 6/1956 | Berke | 229/109 |
| 2,885,073 | 5/1959 | Bettoli et al. | 229/939 |
| 3,512,697 | 5/1970 | Robinson . | |
| 3,923,234 | 12/1975 | Lund . | |
| 4,291,826 | 9/1981 | Swanson | 29/930 |
| 4,676,429 | 6/1987 | Crowe et al. | 229/109 |
| 4,765,534 | 8/1988 | Zion . | |
| 4,792,084 | 12/1988 | Dreeszen | 229/109 |
| 4,919,326 | 4/1990 | Deiger . | |
| 4,984,734 | 1/1991 | Zion . | |
| 4,993,625 | 2/1991 | Stease . | |
| 5,000,374 | 3/1991 | Deiger . | |
| 5,071,062 | 12/1991 | Bradley . | |
| 5,139,196 | 8/1992 | Fry et al. | 229/109 |
| 5,219,118 | 6/1993 | Callahan . | |
| 5,261,594 | 11/1993 | Brown . | |

FOREIGN PATENT DOCUMENTS

| | | | |
|---|---|---|---|
| 1389146 | 1/1965 | France | 229/930 |

*Primary Examiner*—Gary E. Elkins
*Attorney, Agent, or Firm*—Michael J. Doyle

[57] ABSTRACT

An eight sided poultry box formed from a unitary blank of corrugated paperboard. The lower ends of each of the four corner panels are provided with folds, the folds extending from peripheral corner portions of the box bottom towards the exterior surfaces of the corner panels. The folds function as abutments and restrict rotational movement of the corner panels about their longitudinal axes occasioned by compressive forces exerted on the box ends during shipment and handling. A first embodiment exhibits special utility as a manually erectable box, while a second embodiment is adapted to be erected by automatic machinery.

6 Claims, 7 Drawing Sheets

WEB BOTTOMED EIGHT SIDED TRAY

BACKGROUND OF THE INVENTION

This invention relates to an eight sided tray typically fashioned of corrugated paperboard. The tray has two main end walls, two main side walls, and four short, slanted corner walls between adjacent pairs of end and side walls. The tray exhibits particular utility as a container for chicken pieces packed in ice which are placed into the tray for storage and shipment.

Such trays, termed poultry trays, have been in use for some time and are formed from a unitary blank of corrugated paperboard, sometimes coated on both sides with wax or other material to impart rigidity and resistance to water degradation. The trays are loaded with a combination of chicken parts and ice, and are provided with holes to permit water (melted ice) to drain. In a filled tray, there are forces due to the weight of the chicken and ice which tend to spread the side walls apart and thus tend to rotate the short corner walls generally about the latter's respective longitudinal axes into parallelism with the end walls. In addition to these internal load forces, there also arise external compressive forces during handling and shipping which are directed against the ends of the tray and sometimes result in a widening of the distance between the opposite side walls and thus also tending to rotate the short corner walls in the same manner. This, in turn, sometimes leads to ripping or tearing of those regions of the tray where the short corner walls meet and extend from the bottom wall of the tray.

SUMMARY OF THE INVENTION

According to this invention, the problem of tearing at the bottom ends of the short corner walls of the tray is inhibited by a J-slot construction. By virtue of this construction, when a tray is formed, a double thickness fold is concurrently formed near each of the four bottom corners of the tray, at the bottom of each short corner wall. Each of these folds functions as an abutment to restrict rotation of the short corner walls and thus inhibit tearing between the bottom of the short corner walls and the bottom wall or panel of the tray.

DETAILED DESCRIPTION OF THE INVENTION

Figure 1:
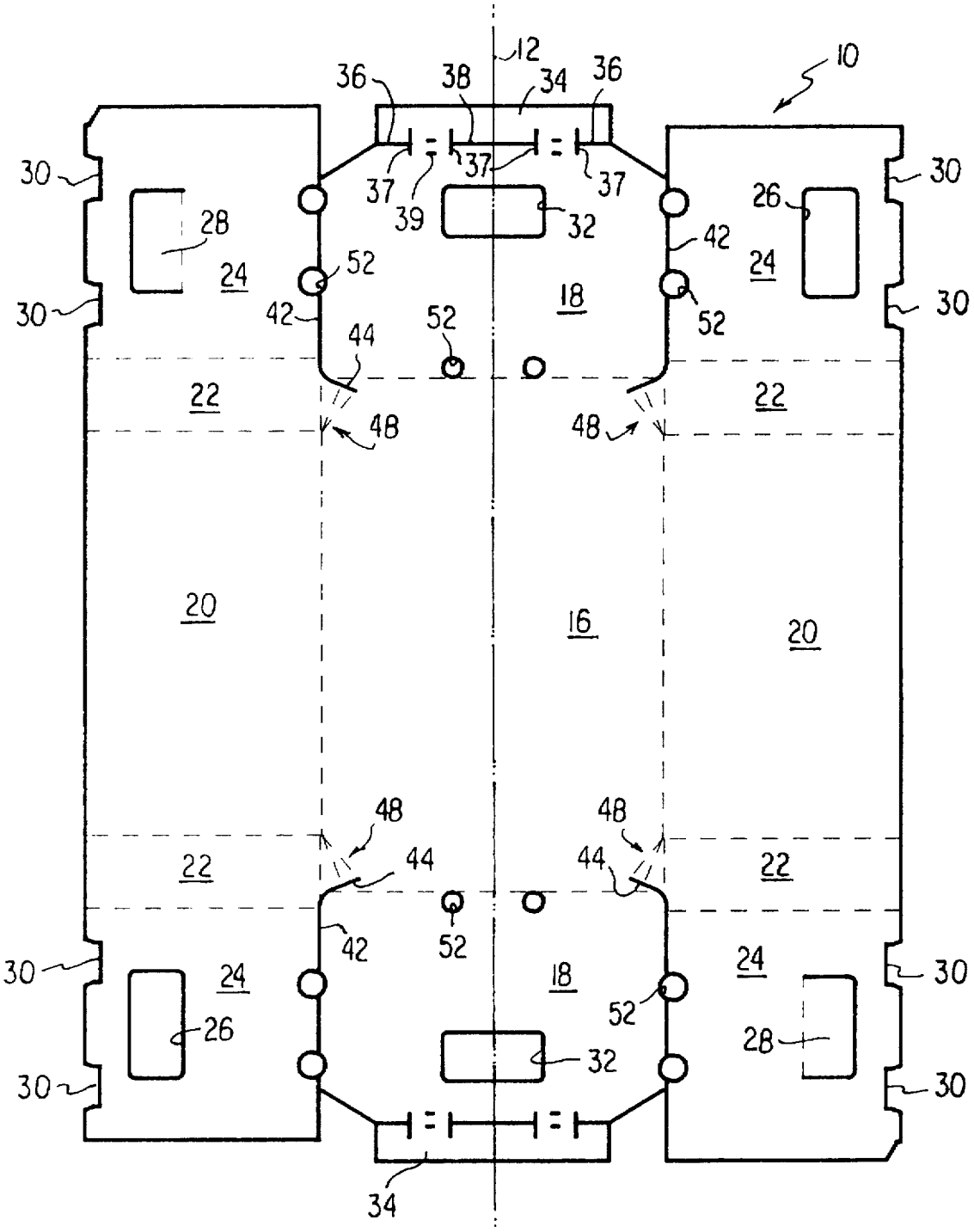
FIG. 1 is a plan view of a unitary blank of corrugated paperboard for forming a manually erectable tray according to this invention.

Referring now to FIG. 1, a unitary blank of corrugated paperboard is designated as 10, and includes a bottom panel

16 having end panels 18 at its upper and lower edges, being joined thereto by the indicated fold lines. Longitudinal side wall panels 20 border panel 16 on opposite or left and right sides, with smaller wall forming panels 22 integral with panels 20. Panels 24 are secured to respective panels 22 and defined end panels. Two of the end panels 24 are provided with hand openings 26, while two other of the panels 24 are provided with similar openings 26, and covered by a foldable flap 28. Each end panel 18 is provided with a hand hold 32. Further, the outermost end of each end panel 18 is provided with cut lines 36, 38, 36, and 37. Between pairs of cut lines 37 pairs of fold or bend promoting cuts 39 are provided. The outermost flap 34 of each end panel 18 thus folds about lines 36, 38, 36. End panels 24 are separated from panel 18 by slits 42 extending through the paperboard. Each slit 42 terminates in a curved or J-portion 44. The crushed area is denoted generally by 48 and is of a triangular shape, the crushed area 48 being shown in greater detail in FIG. 2. Drain holes 52 are provided, as is conventional, to permit melting ice to drain from the carton.

It is seen that panels 16 and 18 are mirror symmetrical about longitudinal axis 12, while the entire blank is also mirror symmetrical about a horizontal mid axis except for flaps 28 which cover two of the four hand holes 26.

Figure 2:
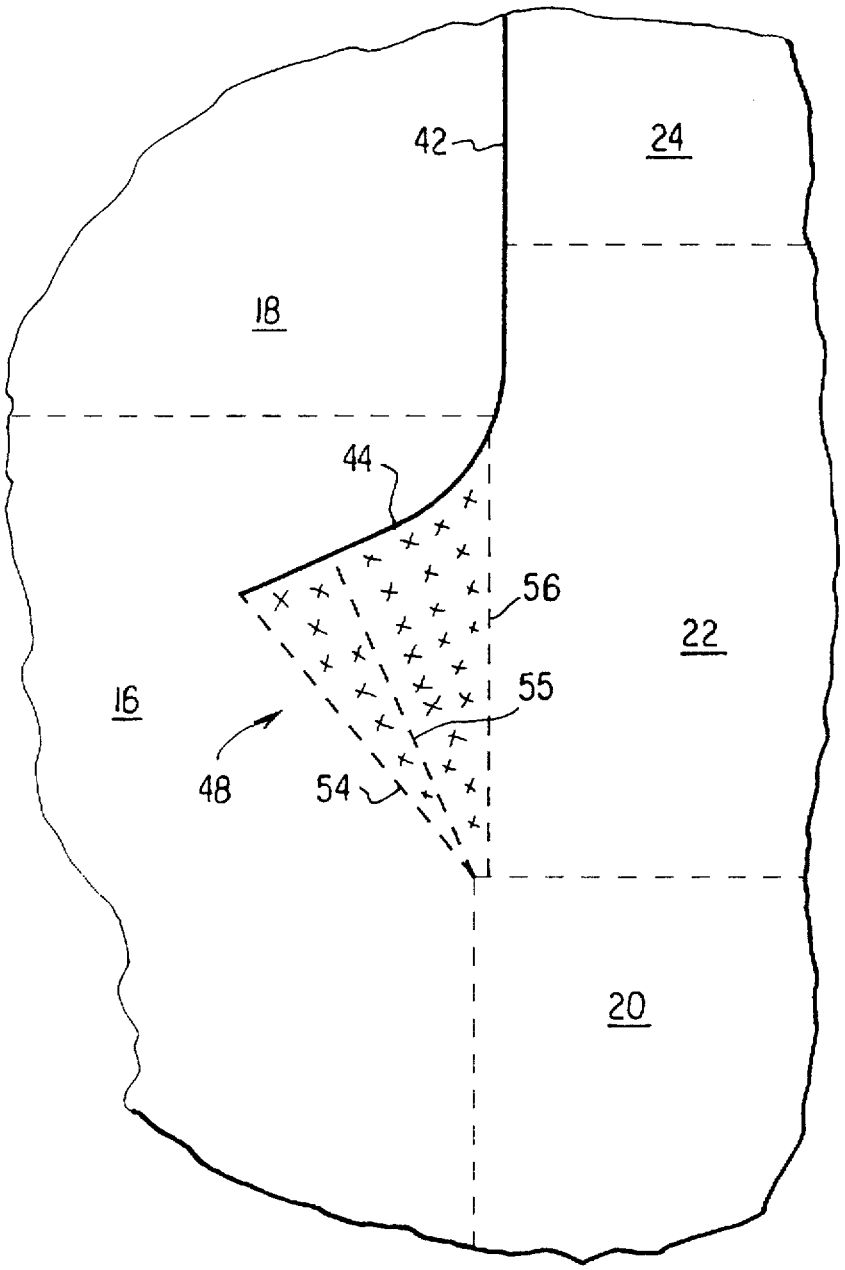
FIG. 2 is an enlarged view of one of the four bottom corner forming regions of the blank of FIG. 1.

Turning now to FIG. 2, an enlarged portion of any of the corners or crushed areas 48 is shown, and the reader will note the triangular area defined by J slit 44 and border slanted fold enhancing crease lines 54 and 56. An intermediate crease line 55 extends through the triangular crushed area 48. The crushing permits triangular areas 48 to be folded upon erection of the tray from the blank, with crease lines 54, 55, and 56 enhancing the folding and rolling of the corrugated paperboard. Such crushing of corrugated paperboard is known, and is typically carried out by rubber or cork abutments acting on the paperboard when it is cut and scored to form the blank.

Figure 3:
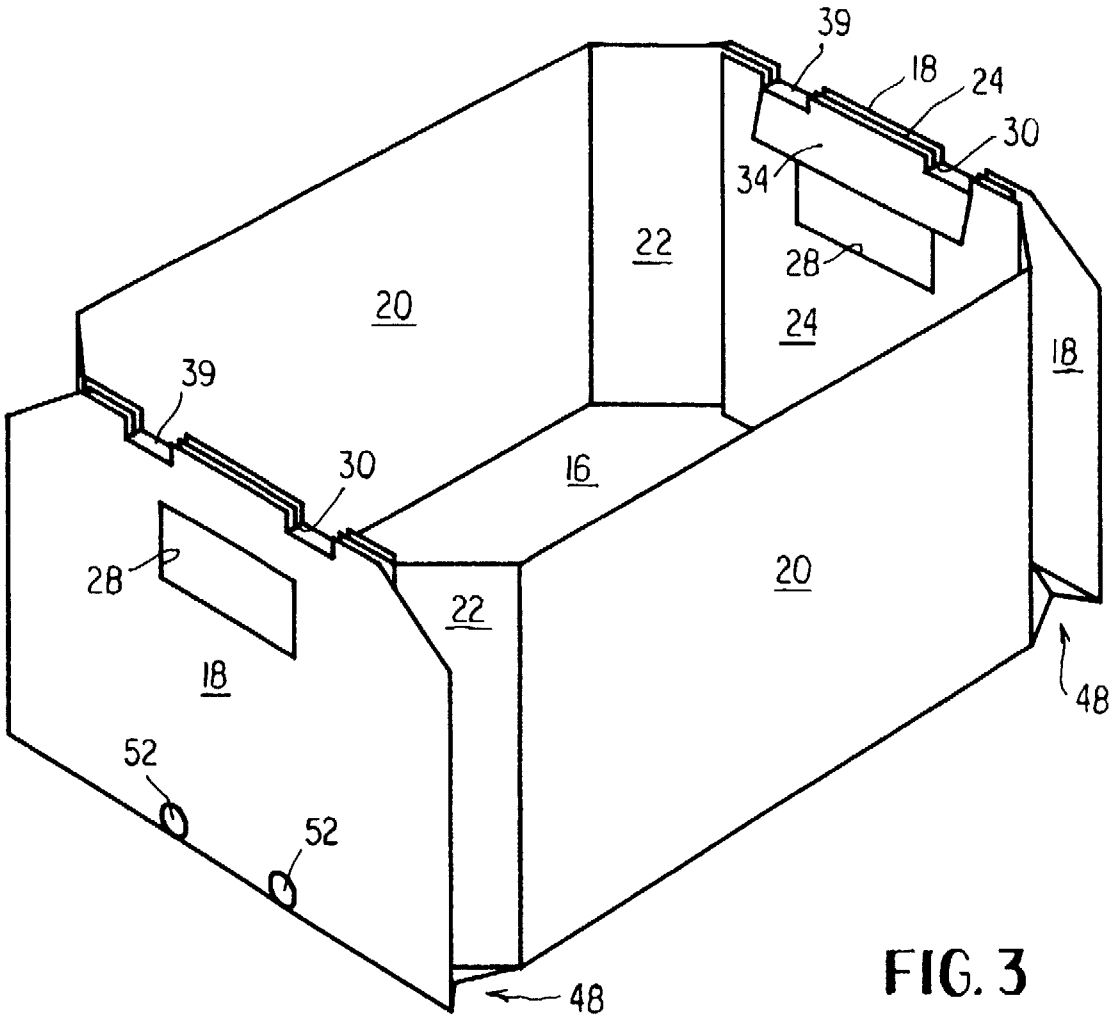
FIG. 3 is a perspective view of the blank of FIG. 1 after it has been manually erected to form the tray of this invention.

Referring now to FIG. 3, the blank of FIG. 1 has been folded and manually erected. Side walls 20, corner walls 22, and end walls 24 are folded up from the plane of central panel 16 about the indicated fold lines. End panels 24 are folded into overlapping surface contact with each other, with their respective openings 26 and tongues 28 aligned with an opening 32 of a respective end panel 18. Thus, the end wall of the tray is composed of three thicknesses of the corrugated board, these being two thicknesses of end panels 24 and an outermost thickness defined by an end panel 18. End flaps 34 are folded over mating notches 30 of panels 24, with these end flaps 34 being folded to the interior portion of the tray. It is seen that the folds made by fold promoting cuts 39 are received by notches 30.

Upon erection, each lower corner of the tray has a fold defined by the material of the triangular crushed regions 48. Each fold restricts rotational movement of a respective corner wall 22 about its respective longitudinal axes upon relative movement of the end walls towards each other (as due to compressive forces being applied to the ends of the loaded trays) so that ripping along the bottom of the corner walls will not occur. Upon such compressive forces, there is a tendency of each corner wall 22 to rotate into parallelism with a respective adjacent end wall, the upper edges of side walls 20 being urged apart by such forces. The folded crushed portions 48 act as abutments to preclude such rotation.

Figure 4:
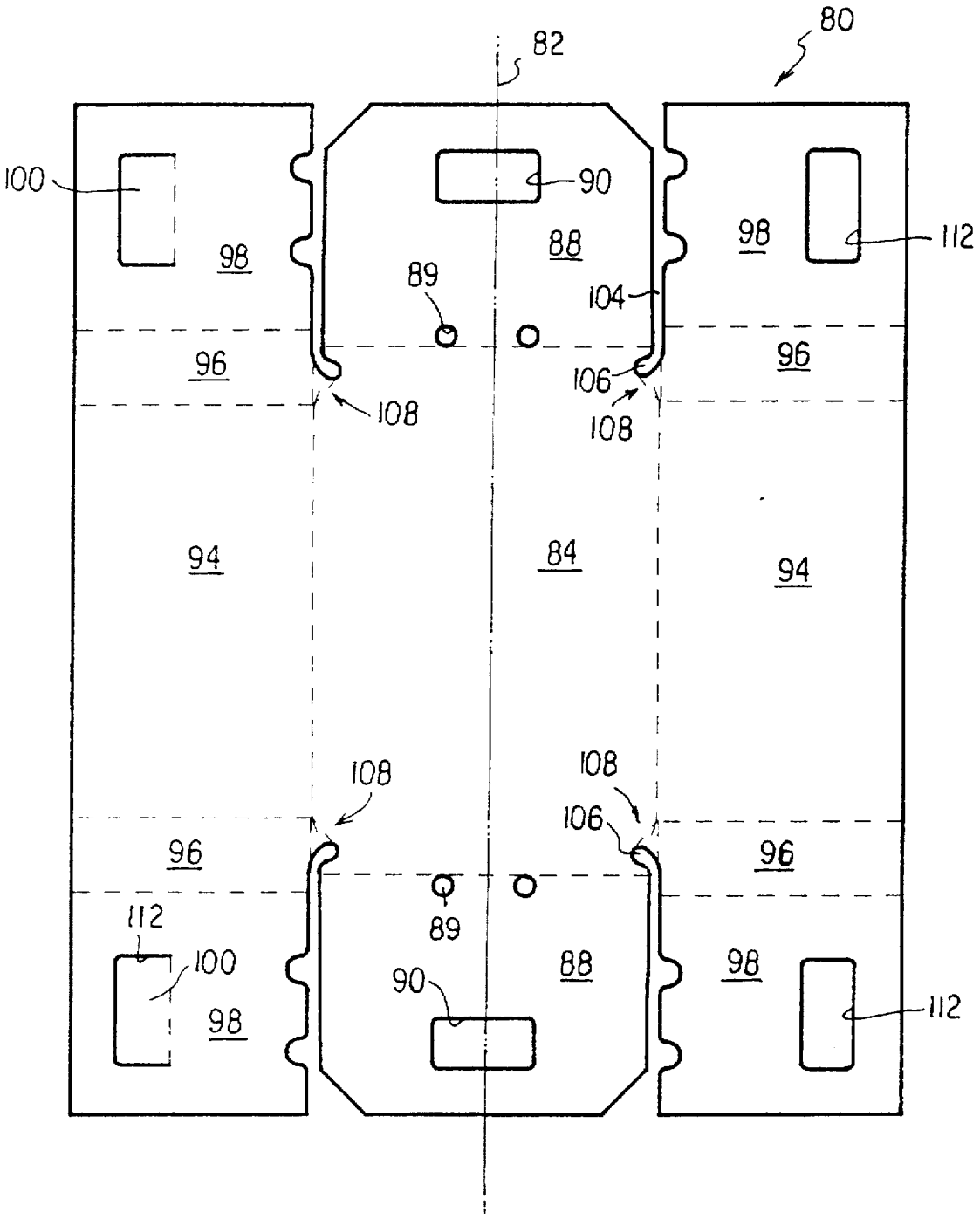
FIG. 4 is a view similar to FIG. 1 and illustrates a modified blank adapted to be erected by automatic machinery.

Referring now to FIG. 4 of the drawings, a unitary blank 80 of corrugated paperboard is shown which is similar in construction and arrangement to that of FIG. 1. A central bottom panel 84 is coupled by the indicated fold lines to end panels 88, the latter each containing a rectangular hand hole 90. Longitudinal side walls 94 are connected to right and left edges of central or bottom panel 84 by the indicated fold lines, with each longitudinal side wall panel 94 foldably secured to respective short side wall panels 96, the latter in turn coupled by the indicated fold lines to respective end panels 98. Two of panels 98 carry hand hole openings covered by foldable flaps 100, while two other end panels 98 carry hand holes 112.

A slot 104 separates central end panels 88 from respective laterally spaced end panels 98. The ends of slots 104 terminate in respective J shaped ends 106. Slots 104 are wider than slits 42 of FIG. 2 because a machine erected tray requires more space between opposed free edges on opposite sides of a cut. After their formation, opposing free edges of slits 42 are in contact with each other, while opposing free edges of slots 104 are spaced from each other.

Figure 5:
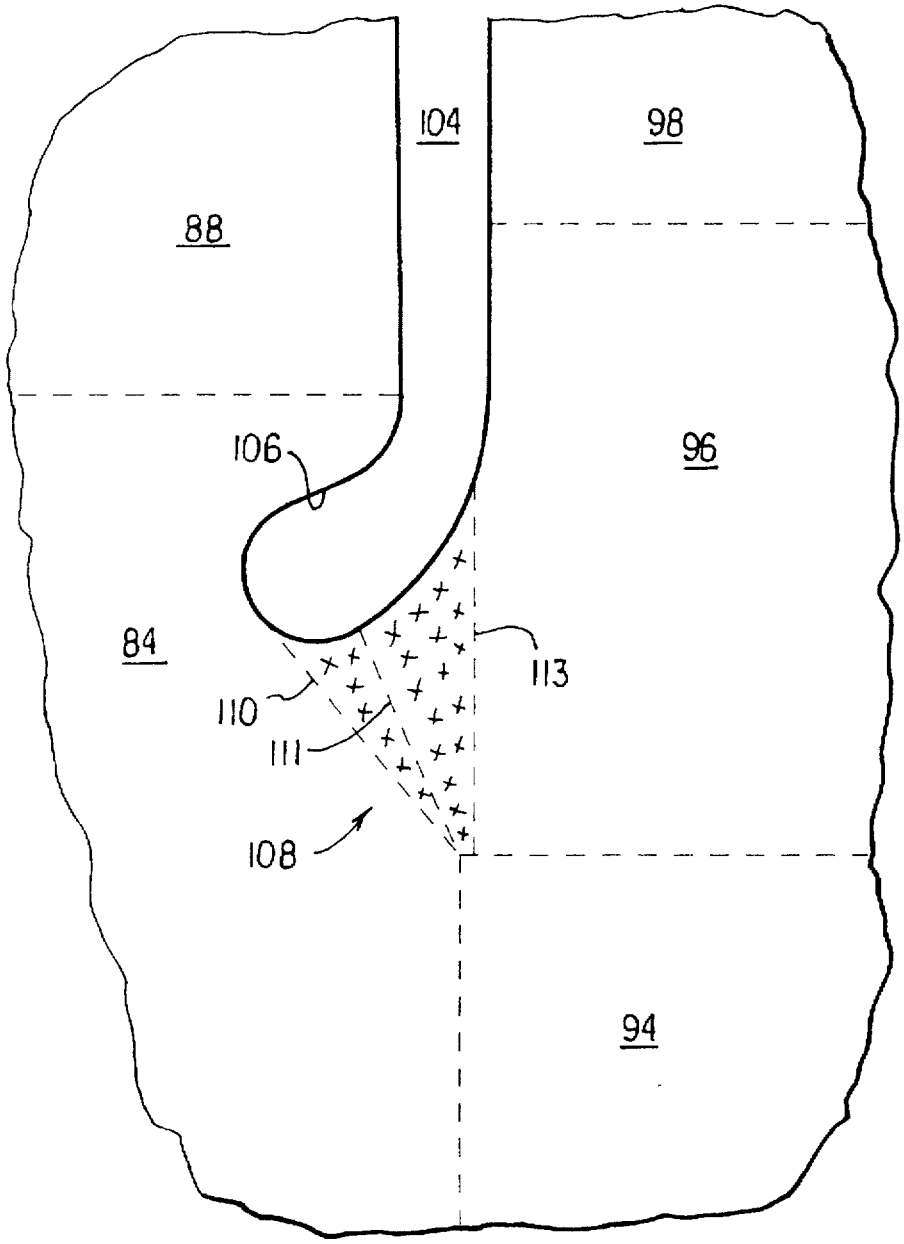
FIG. 5 is an enlarged view of one of the four bottom corner regions of the blank of FIG. 4.

FIG. 5 illustrates in greater detail crushed areas 108 which are generally triangular and bounded by creased fold enhancing lines 110 and 113. An intermediate crease line, also to enhance folding, is denoted as 111. These crushed areas are similar in function to crushed areas 48 of FIG. 2 and are formed in a similar manner.

Figure 6:
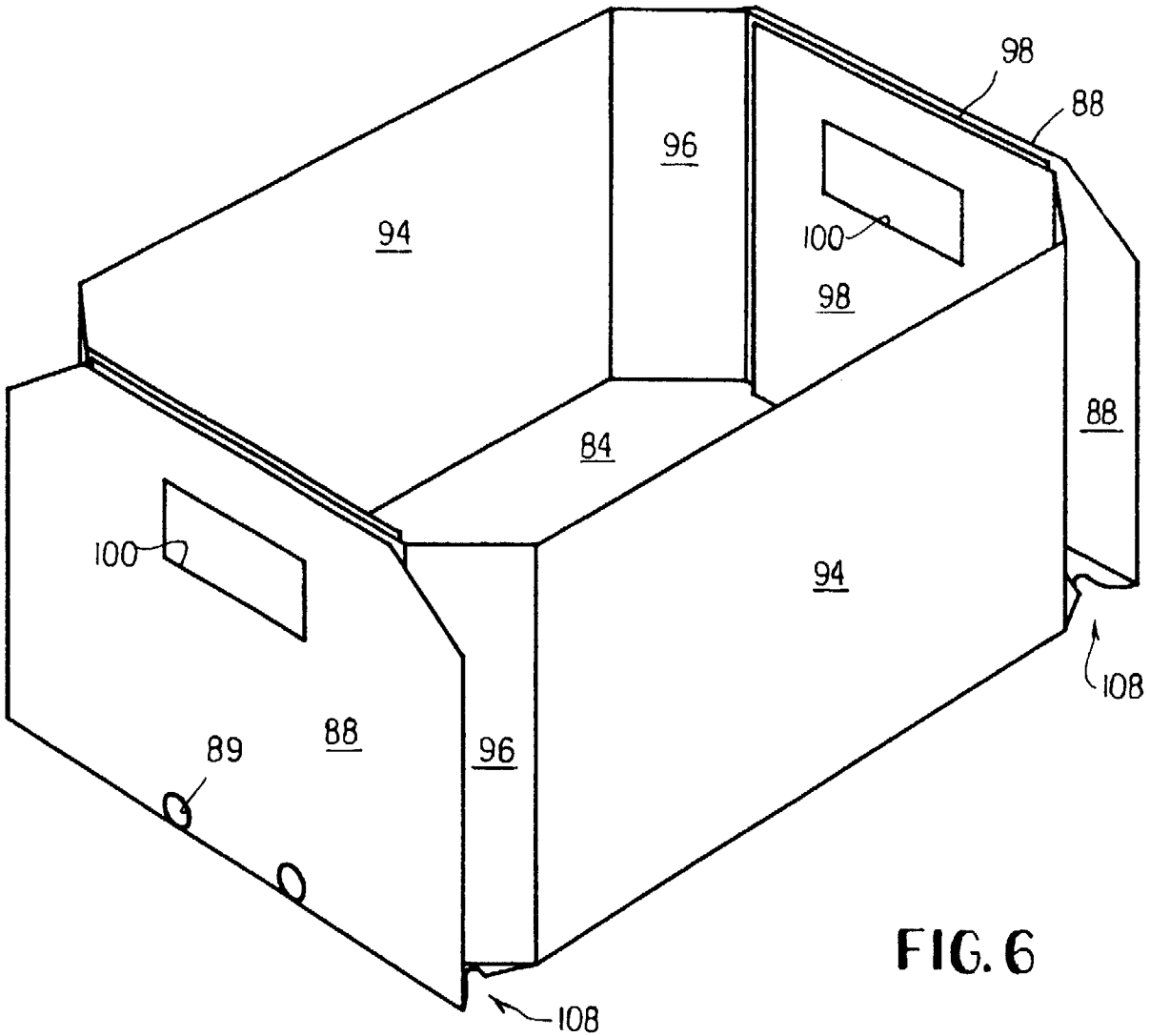
FIG. 6 is a perspective view showing the blank of FIG. 4 as having been erected.

FIG. 6 illustrates the blank of FIG. 4 after it has been folded and set up and glued as by an automatic machine. A machine suitable for automatically setting up and erecting the blank is Model 1T6 Tray Former, with an optional corner former, made by SWF Machinery of Sanger, Calif. Panels 98 are overlapping and in surface contact with each other, with end panels 88 being on the outside of the tray. Glue is applied to the surfaces of panels 88 and 98, such that a three thickness end wall structure is defined in the completed tray. Again, crushed area 108 permits a rolling or folding of the paperboard as to prevent rupture or tearing when there is relative movement between side walls 94, corner walls 96, and the remainder of the tray as may be occasioned upon end compressive forces applied to the end walls of the filled trays.

Figure 7:
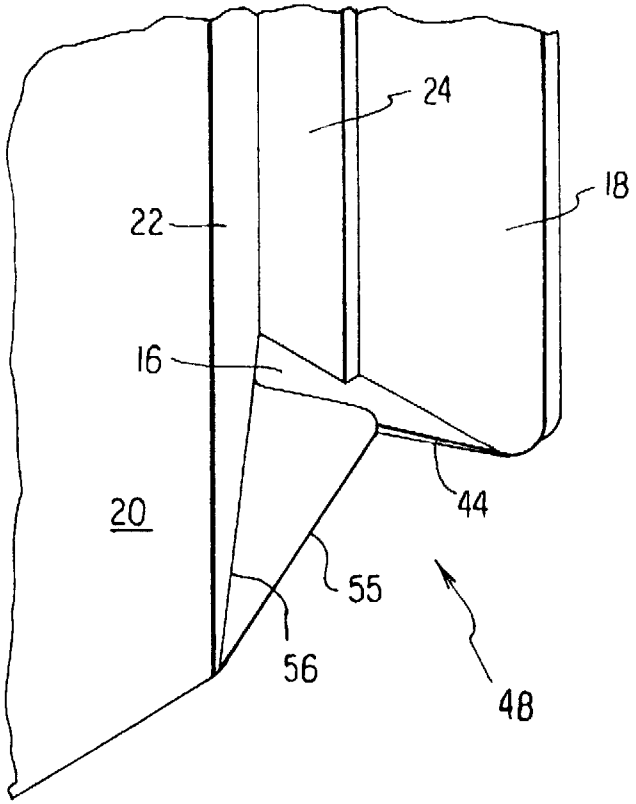
FIG. 7 is an enlarged perspective view of one of the bottom corners of the container of FIG. 3.

FIG. 7 shows in greater detail one of the bottom corners of the container of FIG. 3. Crushed triangular portion 48 is seen as folded over itself. Taking FIG. 2 with FIG. 7, bottom panel 16 is seen with a part of its slit 44 exposed after folding the triangular crush area 48 about middle fold line 55. At FIG. 7 the triangular area between lines 54 and 55 (see FIG. 2) is beneath and in substantial surface contact with the visible triangular area between lines 55 and 56.

Figure 8:
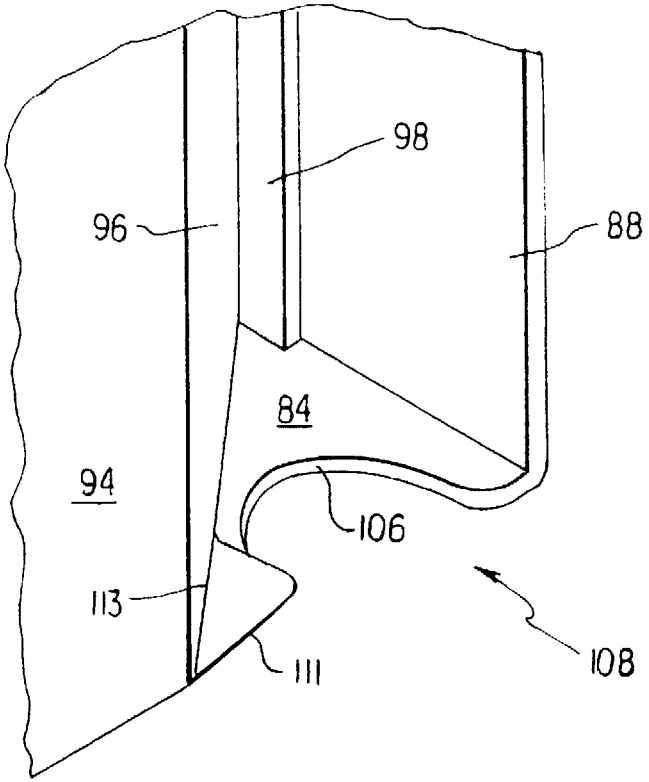
FIG. 8 is an enlarged perspective view of one of the bottom corners of the container of FIG. 6.

FIG. 8 shows in greater detail one of the bottom corners of the container of FIG. 6, with the folding action and configuration being similar to that shown in FIG. 7. Crushed triangular portion 108 is seen as folded over itself. Taking FIG. 6 with FIG. 8, bottom panel 84 is seen with a part 106 of its slot 104 further exposed after folding the triangular crush area 108 about middle fold line 111. At FIG. 8 the triangular area between lines 110 and 111 (see FIG. 5) is beneath and in substantial surface contact with the visible triangular area between lines 111 and 113.

The rotation preventing action of triangular crushed areas 108 is the same as the rotation preventing action of triangular crushed areas 48 previously described. Namely, folded areas 108 act as abutments to prevent rotation of respective corner walls 96 about the longitudinal (vertical) axes of the latter upon the spreading apart of the upper edges of the side walls due to tray end compressive forces.

I claim:

1. A unitary corrugated paperboard blank for forming an eight sided poultry tray, said blank having one bottom, two side, four corner, and six end panels, said bottom panel having two ends and an end panel foldably secured to respective said ends, said bottom panel having two side edges and a side panel foldably secured to respective said side edges, said bottom panel having four corners, said side panels each having two ends and a respective corner panel foldably secured to respective ends of said side panels, said corner panels each being foldably connected to a respective said end panel, said blank having two ends and three horizontally aligned end panels at each end thereof, cuts through said paperboard separating said end panels at each end from each other, said cuts each having inner J-shaped ends, said J-shaped ends bordering a crushed area, each of said crushed areas located contiguous to and at the bottom of a respective corner of said bottom panel, whereby upon erecting a poultry tray from said blank said crushed areas form folds at lower ends of said corner panels, said folds restricting rotational movement of said corner panels and thus prevent tearing between said lower ends of the corner panels and said bottom panel.

2. The blank of claim 1 wherein said crushed areas are triangular, one side of each said triangular crushed area bordering on one of said corner panels.

3. The blank of claim 1 wherein said cuts are slits.

4. The blank of claim 1 wherein said cuts are slots.

5. A poultry box formed from a unitary corrugated paperboard blank, said box having an interior, said box having a bottom panel, opposed side panels, corner panels, and two opposed end walls, said side walls, corner panels, and end walls being vertical and having upper free edges and lower ends, said corner panels located between said end walls and said side walls, said corner panels and said side panels foldably connected to said bottom panel, a fold at said lower end of each said corner panel, each said fold formed of a crushed area of said corrugated paperboard, whereby said corner walls do not tear from said bottom panel upon the application of end compressive forces to said box, which forces tend to rotate said corner walls about their respective longitudinal axes.

6. The poultry box of claim 5 wherein each said fold is on that surface of each said corner panel remote from said interior.

* * * * *